US007549245B2

(12) United States Patent
Ter-Hovhannissian

(10) Patent No.: US 7,549,245 B2
(45) Date of Patent: Jun. 23, 2009

(54) SELF-CONTAINED, SOLAR-POWERED ILLUMINATED SIGN

(76) Inventor: Artak Ter-Hovhannissian, 11144 Penrose St., Unit 11, Sun Valley, CA (US) 91352

( * ) Notice: Subject to any disclaimer, the term of this patent is extended or adjusted under 35 U.S.C. 154(b) by 0 days.

(21) Appl. No.: 11/044,429

(22) Filed: Jan. 26, 2005

(65) Prior Publication Data

US 2006/0162204 A1 Jul. 27, 2006

(51) Int. Cl.
*G09F 13/04* (2006.01)

(52) U.S. Cl. ..... 40/546; 40/607.09

(58) Field of Classification Search ..... 40/204, 40/546, 607.09; 362/604, 605, 616
See application file for complete search history.

(56) References Cited

U.S. PATENT DOCUMENTS

| | | | | |
|---|---|---|---|---|
| 5,007,190 | A | 4/1991 | Shyu | |
| 5,101,329 | A * | 3/1992 | Doyle | 362/183 |
| 5,228,223 | A * | 7/1993 | Lan | 40/204 |
| 5,329,716 | A | 7/1994 | Fite | |
| 5,467,076 | A * | 11/1995 | Ruocco et al. | 340/571 |
| 5,729,924 | A | 3/1998 | Reading | |
| 6,003,255 | A | 12/1999 | Mahoney et al. | |
| 6,004,002 | A | 12/1999 | Giannone | |
| 6,263,601 | B1 | 7/2001 | Emert | |
| D451,147 | S | 11/2001 | Mayfield-Mitchell | |
| 6,604,840 | B2 | 8/2003 | Watson | |
| 6,705,033 | B1 * | 3/2004 | Greene et al. | 40/546 |
| 2003/0103345 | A1 | 6/2003 | Nolan | |
| 2004/0250457 | A1 * | 12/2004 | Strein et al. | 40/547 |
| 2004/0255497 | A1 * | 12/2004 | Venkataraman et al. | 40/551 |

FOREIGN PATENT DOCUMENTS

| | | | |
|---|---|---|---|
| GB | 2030750 | A * | 4/1980 |

* cited by examiner

*Primary Examiner*—Joanne Silbermann
(74) *Attorney, Agent, or Firm*—Kelly Lowry & Kelley, LLP

(57) ABSTRACT

An illuminated sign includes a first light source disposed within a frame. A plurality of light guides are spaced apart within the frame and positioned perpendicularly adjacent to the first light source. A first light-permeable panel is disposed adjacent to the light guides and encloses a first side of the frame. A solar panel for generating electricity is associated with the frame and a transformer electrically connects the first light source to the solar panel. A battery is electrically disposed between the solar panel and the transformer; and a timer electrically connects the solar panel and the first light source.

18 Claims, 1 Drawing Sheet

SELF-CONTAINED, SOLAR-POWERED ILLUMINATED SIGN

BACKGROUND OF THE INVENTION

The present invention generally relates to signs. More particularly, the present invention relates to an illuminated sign.

Signs have been around for many years and have served a variety of purposes. Signs, such as real estate signs and business signs, are used to attract attention to a particular location and convey information related to that location. For example, real estate signs have been adapted for the specific purpose of attracting interested persons to a particular piece of property that is for sale or lease. Many different types of conventional real estate signs have been developed over time. These real estate signs are metallic and supported by metal or wood structures that are secured to the front lawn of a piece of property in a location that is visible to the public. These conventional signs are typically thin, rectangular panels overlaid with text and indicia. These real estate signs are typically supported by a wooden cross arm structure from which the real estate sign is suspended.

However, these conventional real estate signs are typically difficult to read or see when it is dark outside as the property may not have any exterior illumination or a convenient streetlight. To solve this problem, illuminated signs have been developed to allow the signs to be seen when lighting conditions are not well suited for viewing the sign or being able to read what the sign says.

There are many examples of illuminated signs. For example, U.S. Pat. No. 6,263,601 discloses a solar-powered illuminated sign. However, the sign is bulky and requires the entire sign to be removed if a component, such as the solar panel, is not functioning properly. In another example, United States Patent Application Publication No. 2003/0103345 discloses an solar-powered illuminated sign. However, the sign is not able to be mounted to a surface or hung from a post.

While illuminated signs such as the ones described above may provide means of providing an illuminated display, such signs can always be improved to provide better illumination.

Accordingly, there is a need for an illuminated sign that provides better illumination of what is being displayed as well as one that does not rely on being connected to a power grid. There is an additional need for a modular illuminated sign that may be switched out with a replacement in the event of damage. The present invention satisfies these needs and provides other related advantages.

SUMMARY OF THE INVENTION

An illuminated sign is illustrated and described that provides a uniform distribution of light across the surfaces to be illuminated, thereby providing better illumination of what is being displayed on the sign. The illuminated sign is able to regulate its periods of illumination and does not rely on being connected to a power grid. A sign of the present invention is also modular so as to be connected to or disconnected from a post with ease in the event of damage or the like to either the post or the sign. This sign is usable in any situation where small, medium and large illuminated signs are hung, including real estate signs displayed on a front lawn of a house to be sold, business signs hung in front of a place of business (e.g., a law office or medical office) and the like.

An illuminated sign includes a first light source disposed within a frame. A plurality of light guides are spaced apart within the frame and positioned perpendicularly adjacent to the first light source. A first light-permeable panel is disposed adjacent to the light guides and encloses a first side of the frame. A solar panel for generating electricity is associated with the frame and a transformer electrically connects the first light source to the solar panel. A battery is electrically disposed between the solar panel and the transformer; and a timer electrically connects the solar panel and the first light source. The timer includes a photo-sensor.

The sign also includes a second light-permeable panel disposed opposite to the first panel. This second panel encloses a second side of the frame that is opposite to the first side. Light emitted from the first light source and light guides illuminates both panels.

The sign further includes a means for connecting the sign to a vertically extending post.

A second light source is also disposed within the frame but is located on an opposite side of the frame from the first light source. The light guides are disposed between the first and second light sources. Light emitted from the light sources enters and exits the light guides to illuminate the panel. Light emitted from the light sources and the light guides illuminates both panels.

The light sources provide illumination for the sign and may come in various forms including, without limitation, a cold cathode light, a plurality of spaced-apart light-emitting diodes, a combination thereof or the like.

A reflector is disposed behind at least one of the light sources within the frame. The panel includes indicia visible both when the panel is illuminated and non-illuminated.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
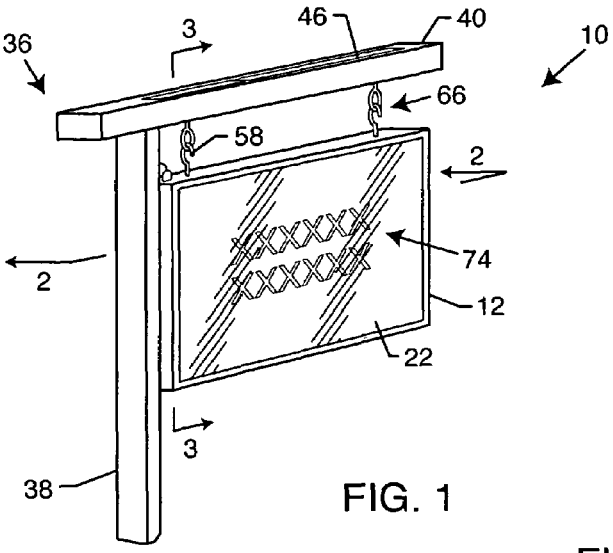
FIG. 1 is an isometric front view a sign embodying the present invention.
Figure 3:
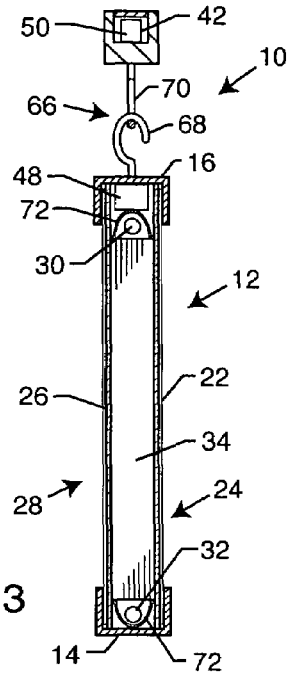
FIG. 3 is a side cross-section elevation view taken along line 3-3 of FIG. 2.
Figure 2:
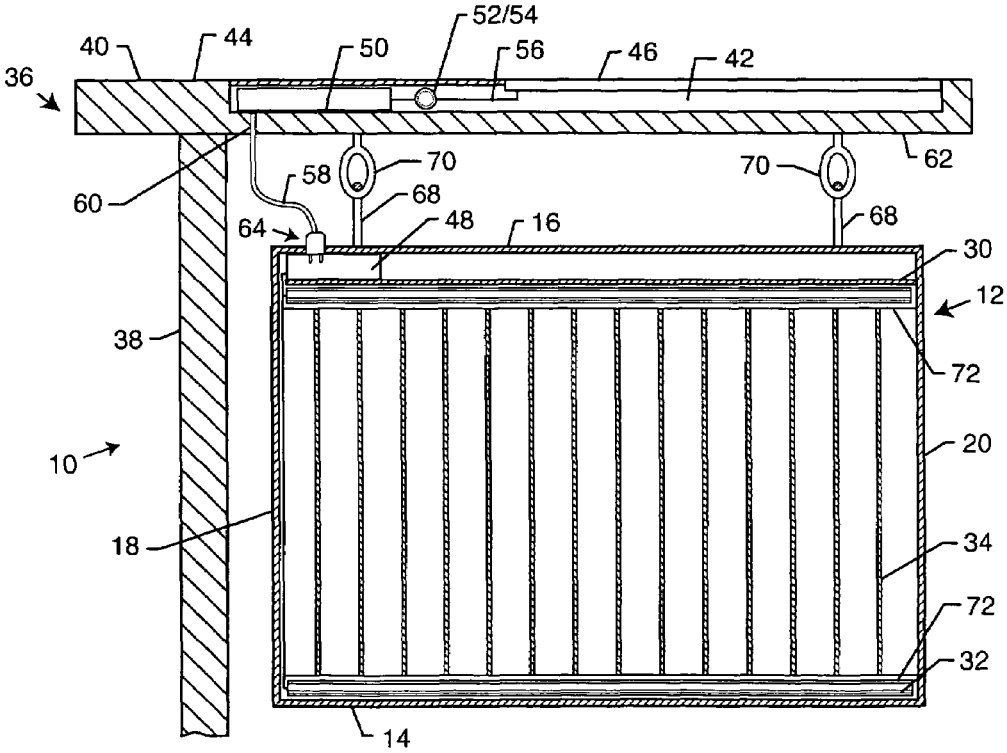
FIG. 2 is front cross-section elevation view taken along line 2-2 of FIG. 1.

As shown in the drawings for purposes of illustration, the present invention resides in a self-contained solar-powered illuminated sign. With reference to FIGS. 1-3, a sign 10 includes a frame 12 in the form of a rectangular box-like structure with a lower horizontal frame member 14, an upper horizontal frame member 16, and two vertical frame members 18, 20. The frame members 14, 16, 18, 20 are U-shaped with the legs of the U facing inwards. The frame 12 may be made of various materials including, without limitation, wood, metal, plastic, composite materials or a combination of the foregoing. The frame members 14, 16, 18, 20 may be held together using conventional methods.

A first light-permeable panel 22 is positioned within the legs of the U-shaped frame members 14, 16, 18, 20 and forms one side 24 of the sign 10 that is used for display. A second light-permeable panel 26 is also positioned within the legs of the U-shaped frame members 14, 16, 18, 20 and forms a side 28 of the sign 10 opposite the side 24 of the frame 12 formed by the first panel 22. The panels 22, 26 may be made of any light-permeable material including, without limitation, glass, plastic or the like. The panels 22, 26 are translucent to aid in the dispersion of light passing through the panels 22, 26. The panels 22, 26 may be various colors including, without limitation, white, blue, yellow, red, green and the like.

An upper light source 30 is located within the frame 12 adjacent to the upper horizontal frame member 16. A lower light source 32 is located within the frame 12 adjacent to the lower horizontal frame member 14. The light sources 30, 32 provide illumination for the sign 10 and come in various forms including, without limitation, a cold cathode light, a plurality of spaced-apart light-emitting diodes (LEDs), neon or other gas discharge light, or a combination of the foregoing.

A plurality of generally rectangular slat-shaped light guides 34 are spaced apart within the frame 12 and positioned perpendicularly adjacent to the first and second light sources 30, 32. The light guides 34 are positioned length-wise between the upper and lower frame members 14, 16. The light guides 34 are disposed between the upper and lower light sources 30, 32 such that light emitted from the light sources 30, 32 enters the light guides 34 at the upper and lower edges of the light guides 34 adjacent to the light sources 30, 32. Light exits from the sides of the light guides 34 along the length of the light guides 34 and illuminates the panel 22, 26. The light guides 34 may be made of various materials including glass, plastic, composite materials and the like.

Light emitted from the upper and lower light sources 30, 32 aide in the illumination of both panels 22, 26. The light guides 34 aid in the illumination of the panels 22, 26 by providing an increased distribution of the light being emitted from the light sources 30, 32. The light guides 34 allow a portion of the light being emitted from the light sources 30, 32 to be directed to illuminate the panels 22, 26 along the length of the light guides 34 in order to minimize 'dark spots' that may result from not enough light reaching portions of the panels 22, 26. The greater the number of light guides 34, the less likely it is for 'dark spots' to form in areas of the panels 22, 26 between the light guides 34.

The sign 10 is connected to a sign post 36 which includes a vertical post 38 extending upwardly from a surface and a horizontal bar 40 connected to the top of the vertical post 38 and extending away therefrom.

The horizontal bar 40 includes an elongated recess 42 along a top surface 44 of the bar 40. A solar panel 46 comprised of a plurality of solar cells for generating electricity is located within the recess 42 and a top surface of the solar panel 46 is generally co-planar with the top surface 44 of the bar.

A transformer 48 is located within a top portion of the frame 12 and electrically connects the light sources 30, 32 to the solar panel 46. An internal rechargeable battery 50 is electrically disposed between the solar panel 46 and the transformer 48 and is located within the recess 42 of the bar 40. A timer 52 is located between the battery 50 and the solar panel 46. The timer 52 serves to electrically connect/disconnect the solar panel 46 and the light sources 30, 32. The timer 52 allows a user to decide at what time the light sources 30, 32 are to be activated and/or deactivated. The timer 52 also includes a photo-sensor 54 which monitors the available solar supply and regulates the illumination of the light sources 30, 32 by dimming or deactivating the light sources 30, 32 during daylight hours and activating the light sources 30, 32 when it is dark. The timer 52 may be set up so that the light sources are set to be activated/deactivated at a particular time but those times may be subject to the levels of illumination detected by the photo-sensor 54 with the activation/deactivation of the light sources 30, 32 effected accordingly.

In sum, light hits the solar panel 46 and is converted into direct electrical current that is transmitted by wire 56 to the battery 50. If the timer 52 is set for a period of illumination and/or if the photo-sensor 54 detects that lighting conditions are at a certain level, the timer 52 allows the current to charge the battery 50. A power cord 58 allows the battery 50 to be electrically connected to the transformer 48, where the direct electrical current is changed to alternating electrical current, when the power cord 58 is plugged into the transformer 48. The power cord 58 passes through a shaft 60 in lower portion 62 of the bar 40 where the power cord 58 accesses the transformer 48 through an opening 64 in the upper horizontal frame member 16.

The sign 10 further includes a means 66 for connecting the sign to the sign post 36 that includes a pair of spaced-apart hooks 68 that are connected to and extending upwardly from the upper horizontal frame member 16 to engage a pair of spaced-apart loops 70 that are connected to and extend downwardly from the horizontal bar 40. When the hooks 68 engage the loops 70, the frame 12 hangs below the bar 40 and is able to pivotally swing thereunder.

A reflector 72 is disposed behind each of the light sources 30, 32 within the frame 12. The reflectors 72 are elongated and positioned behind each of the light sources to reduce the amount of light emitted by the light sources 30, 32 that is wasted and re-direct light towards the panels 22, 26. The reflectors 72 may be of various shapes including, without limitation, parabolic, elliptical or the like. In the alternative, if at least one of the light sources 30, 32 is in the form of a plurality of spaced-apart LEDs, then each LED may have its own individual reflector 72 positioned behind it.

At least one of the panels 22, 26 includes indicia 74 that is visible regardless of whether the panel 22, 26 is illuminated. The indicia 74 may be in various forms including, without limitation, alphanumeric text, logos, designs or the like.

Although an embodiment has been described in detail for purposes of illustration, various modifications may be made without departing from the scope and spirit of the invention.

What is claimed is:

1. An illuminated sign, comprising:

a first light source disposed within a frame;

a first light-permeable panel positioned within the frame adjacent to the first light source;

a plurality of slat-shaped light guides spaced apart within the frame adjacent to the first light source and perpendicular to the first light-permeable panel;

a solar panel for generating electricity, associated with the frame;

a transformer electrically connecting the first light source to the solar panel;

a battery electrically disposed between the solar panel and the transformer; and a timer electrically connecting the solar panel and the first light source.

2. The sign of claim 1, including a second light-permeable panel disposed opposite to the first panel and positioned within the frame opposite the first light-permeable panel, wherein light emitted from the first light source and light guides illuminates both panels.

3. The sign of claim 1, including means for connecting the sign to a vertically extending post.

4. The sign of claim 1, including a second light source disposed within a lower portion of the frame opposite to the first light source disposed in an upper portion of the frame, the light guides being disposed therebetween, wherein light emitted from the light sources enters and exits the light guides to illuminate the panel.

5. The sign of claim 1, wherein the first light source comprises a cold cathode light.

6. The sign of claim 1, wherein the first light source comprises a plurality of spaced-apart light-emitting diodes.

7. The sign of claim 1, including a reflector disposed behind the first light source within the frame.

8. The sign of claim 1, wherein the panel includes indicia visible both when the panel is illuminated and non-illuminated.

9. The sign of claim 1, wherein the timer includes a photo-sensor.

10. An illuminated sign, comprising:

a first light source disposed within an upper portion of a frame;

a second light source disposed within a lower portion of the frame opposite to the first light source;

a first light-permeable panel positioned within the frame adjacent to the light sources;

a second light-permeable panel positioned within the frame opposite the first light-permeable panel;

a plurality of light guides spaced apart within the frame extending between the first light source and the second light source and perpendicular to the first and second light-permeable panels, wherein light emitted from the first and second light sources enters and exits the light guides to illuminate the first and second panels;

a solar panel for generating electricity, associated with the frame;

a transformer electrically connecting the first light source to the solar panel;

a battery electrically disposed between the solar panel and the transformer;

a timer electrically connecting the solar panel and the first light source; and means for connecting the sign to a vertically extending post.

11. The sign of claim 10, wherein at least one of the first and second light sources comprises a cold cathode light.

12. The sign of claim 10, wherein at least one of the first and second light sources comprises a plurality of spaced-apart light-emitting diodes.

13. The sign of claim 10, including a reflector disposed behind at least one of the light sources within the frame.

14. The sign of claim 10, wherein at least one panel includes indicia visible both when the panel is illuminated and non-illuminated.

15. The sign of claim 10, wherein the timer includes a photo-sensor.

16. An illuminated sign, comprising:

a first light source disposed within an upper portion of a substantially enclosed frame;

a second light source disposed within a lower portion of the frame opposite the first light source, wherein the frame includes a reflector disposed behind at least one of the light sources within the frame;

a first light-permeable panel positioned within the frame adjacent to the first and second light sources;

a second light-permeable panel positioned within the frame opposite the first light-permeable panel, where at least one of the panels includes indicia visible both when at least one of the panels is illuminated and non-illuminated;

a plurality of light guides spaced apart within the frame adjacent to and extending substantially between the first and second light sources and disposed between the first light-permeable panel and the second light-permeable panel, wherein light emitted from the first and second light sources enters and exits the light guides to illuminate the first and second light-permeable panels;

a solar panel for generating electricity, associated with the frame;

a transformer electrically connecting the light sources to the solar panel;

a battery electrically disposed between the solar panel and the transformer;

a timer including a photo-sensor, electrically connecting the solar panel and the light sources; and means for connecting the sign to a vertically extending post.

17. The sign of claim 16, wherein at least one of the first and second light sources comprises a cold cathode light.

18. The sign of claim 16, wherein at least one of the first and second light sources comprises a plurality of spaced-apart light-emitting diodes.

* * * * *